US011501623B1

(12) United States Patent
Tang et al.

(10) Patent No.: US 11,501,623 B1
(45) Date of Patent: Nov. 15, 2022

(54) ARRANGEMENT APPARATUS FOR MULTIPLE INTEGRATED SENSORS IN DEEP POSITION OF SLIDING MASS AND ARRANGEMENT METHOD

(71) Applicant: CHINA UNIVERSITY OF GEOSCIENCES (WUHAN), Wuhan (CN)

(72) Inventors: Huiming Tang, Wuhan (CN); Junrong Zhang, Wuhan (CN); Yongquan Zhang, Wuhan (CN); Changdong Li, Wuhan (CN)

(73) Assignee: CHINA UNIVERSITY OF GEOSCIENCES (WUHAN), Wuhan (CN)

( * ) Notice: Subject to any disclaimer, the term of this patent is extended or adjusted under 35 U.S.C. 154(b) by 14 days.

(21) Appl. No.: 17/367,590

(22) Filed: Jul. 5, 2021

Related U.S. Application Data

(63) Continuation of application No. PCT/CN2021/098093, filed on Jun. 3, 2021.

(30) Foreign Application Priority Data

May 14, 2021 (CN) ..... 202110527817

(51) Int. Cl.
*G08B 21/10* (2006.01)
*E21B 47/01* (2012.01)

(52) U.S. Cl.
CPC ..... *G08B 21/10* (2013.01); *E21B 47/01* (2013.01)

(58) Field of Classification Search
CPC ..... G08B 21/10; E21B 47/01
See application file for complete search history.

(56) References Cited

U.S. PATENT DOCUMENTS

| | | | | |
|---|---|---|---|---|
| 1,815,661 | A * | 7/1931 | Williston | E21B 49/06 175/45 |
| 8,135,444 | B2 | 3/2012 | Hildebrand et al. | |
| 8,175,345 | B2 | 5/2012 | Gardner | |
| 9,599,630 | B2 | 3/2017 | Sweet et al. | |
| 10,370,919 | B2 * | 8/2019 | Hansen | E21B 47/06 |

(Continued)

FOREIGN PATENT DOCUMENTS

| | | | | |
|---|---|---|---|---|
| CA | 2284456 | A1 * | 4/2000 | E21B 49/10 |

*Primary Examiner* — Nabil H Syed
*Assistant Examiner* — Cal J Eustaquio
(74) *Attorney, Agent, or Firm* — True Shepherd LLC; Andrew C. Cheng

(57) ABSTRACT

A penetration-type monitor includes a casing pipe and sensor penetration scissors, the sensor penetration scissors are arranged in a shear shape, and a first blade and a second blade rotate close to each other or away from each other in the vertical direction so as to define an initial position and a monitoring position of the sensor penetration scissors; when the sensor penetration scissors are located at the initial position, ends of pressed portions of the first blade and the second blade are arranged at an interval one above the other, when the sensor penetration scissors are located at the monitoring position, the pressed portions move close to each other, and shearing portions penetrate out of a mounting hole to shear a sliding mass; and a monitor arrangement system drives the sensor penetration scissors to move from the initial position to the monitoring position.

9 Claims, 11 Drawing Sheets

(56) References Cited

U.S. PATENT DOCUMENTS

| | | | | |
|---|---|---|---|---|
| 2002/0195247 | A1* | 12/2002 | Ciglenec | E21B 49/00 166/250.11 |
| 2003/0094282 | A1* | 5/2003 | Goode | E21B 49/10 166/255.2 |
| 2005/0171699 | A1* | 8/2005 | Zazovsky | E21B 47/06 702/11 |
| 2005/0242807 | A1* | 11/2005 | Freedman | G01V 11/00 324/303 |
| 2006/0129365 | A1* | 6/2006 | Hammond | E21B 49/008 703/10 |
| 2008/0111551 | A1* | 5/2008 | Freedman | G01V 8/02 324/324 |
| 2011/0198078 | A1* | 8/2011 | Harrigan | E21B 49/10 166/254.2 |
| 2011/0297371 | A1* | 12/2011 | Church | E21B 47/11 166/66 |
| 2020/0003054 | A1* | 1/2020 | Yuratich | E21B 49/08 |

* cited by examiner

ARRANGEMENT APPARATUS FOR MULTIPLE INTEGRATED SENSORS IN DEEP POSITION OF SLIDING MASS AND ARRANGEMENT METHOD

CROSS REFERENCE TO RELATED APPLICATION(S)

This application is a continuation of International Patent Application No. PCT/CN2021/098093 with a filing date of Jun. 3, 2021, designating the United States, now pending, and further claims priority to Chinese Patent Application No. 202110527817.4 with a filing date of May 14, 2021. The content of the aforementioned applications, including any intervening amendments thereto, are incorporated herein by reference.

TECHNICAL FIELD

The present disclosure relates to the technical field of geological disaster monitoring and prevention, and particularly relates to an arrangement apparatus for multiple integrated sensors in a deep position of a sliding mass and an arrangement method.

BACKGROUND

As a common geological disaster, landslide most frequently and widely occurs in nature, seriously threatening our living environments, natural resources, water conservancy projects, etc. It is reported that since the initial impoundment of the Three Gorges Reservoir in 2003, a large number of ancient landslides re-slide owing to periodic water level fluctuation of the Reservoir and rainfall, which has great potential danger. The deformation of landslide is evolved dynamically and spatiotemporally, basic landslide features are closely correlated and matched with evolution stages and evolution models, and the evolution process is usually accompanied with multi-field coupling features.

Single-hole multi-sensor integrated arrangement has become an important aspect in continuous development of the technology for monitoring landslide multi-field information in recent years. In view of the defects of low efficiency, high cost, poor correlation, etc. in an existing multi-instrument independent distribution type integrated monitoring method, a concept of "multi-measurement in one hole" has been gradually proposed in recent years and considered promising by the engineering geologists. Although the "multi-measurement in one hole" is generally considered promising and has developed substantially, it still has technical defects. For example, a monitoring instrument is installed in a hole in an existing monitoring method, which is suitable for deep inclination measurement and underground water level measurement, but cannot accurately measure parameters of pore water pressure and water content etc. in situ. Moreover, the method has poor environmental adaptability, and when the landslide deformation is increased, the instrument in the hole is prone to damage and malfunction, so a multi-information parameter monitoring technology of "multi-measurement in one hole" is not workable under the in-situ condition. Meanwhile, under the condition that soil on the side wall of the borehole is compact and part of sliding mass is made of gravel soil or more compact materials, arrangement of the multi-parameter sensor in the borehole is often challenging. Therefore, it is important to develop the multi-information parameter monitoring technology capable of achieving "multi-measurement in one hole" in situ and a corresponding arrangement device for an underground multi-parameter monitoring sensor.

SUMMARY

In order to solve the problem, the embodiments of the present disclosure provide an arrangement apparatus for multiple integrated sensors in a deep position of a sliding mass and an arrangement method.

The embodiments of the present disclosure provides an arrangement apparatus for multiple integrated sensors in a deep position of a sliding mass, the apparatus including:

a penetration-type monitor including a casing pipe and sensor penetration scissors, where the casing pipe extends in a vertical direction and is configured to be lowered into a borehole, a mounting hole extending in the vertical direction penetrates through a side wall of the casing pipe, and vertical grooves extending in the vertical direction are provided in opposite side walls of the mounting hole;

the sensor penetration scissors are used for obtaining monitoring data of a sliding mass, is arranged in a shear shape and includes a first blade and a second blade which are connected by means of a pin, the first blade and the second blade rotating close to each other or away from each other in the vertical direction so as to define an initial position and a monitoring position of the sensor penetration scissors, outer ends of the first blade and the second blade being shearing portions, inner ends thereof being pressed portions, and ends of the pressed portions being located in the casing pipe; and sliders are arranged at positions, opposite the vertical grooves, of the pressed portions, and the sliders slide up and down in the vertical grooves;

when the sensor penetration scissors are located at the initial position, the ends of the pressed portions of the first blade and the second blade may be arranged at an interval one above the other; and when the sensor penetration scissors are located at the monitoring position, the pressed portions move close to each other, and the shearing portions penetrate out of the mounting hole to shear the sliding mass; and a monitor arrangement system driving the sensor penetration scissors to move from the initial position to the monitoring position.

Further, the monitor arrangement system may include a traction mechanism and an arrangement probe which may be placed into the casing pipe, the arrangement probe having a vertical movement stroke, and the traction mechanism being connected to the arrangement probe so as to pull the arrangement probe to move in the vertical direction;

the arrangement probe may include a housing, two abutting portions, two first driving mechanisms and a second driving mechanism; where each abutting portion may be movably mounted on the corresponding first driving mechanism, and the two abutting portions may be provided with avoiding positions located on an inner side of the pressed portion and pressing positions located on an upper side and a lower side of the pressed portion separately; the first driving mechanisms may be movably mounted on the housing in the vertical direction and drive the abutting portions to be switched between the avoiding positions and the pressing positions separately; and the second driving mechanism may be fixed to the housing and drives the first driving mechanisms to move close to each other in the vertical direction to drive the two pressed portions to rotate close to each other, so as to move the sensor penetration scissors from the initial position to the monitoring position.

Further, the arrangement probe may further include two connection rod assemblies; the housing may be hollow, an elongated hole extending in the vertical direction may penetrate a side wall of the housing, and the two second driving mechanisms may be arranged in the housing at an interval one above the other; the connection rod assemblies may correspond to the second driving mechanisms in a one-to-one manner, be located between the two second driving mechanisms and include force bearing boxes, first hinge support seats, hinge rods and Y-shaped hinge rods;

the force bearing boxes may be fixed to the second driving mechanisms, the two first hinge support seats may be located between the two force bearing boxes, and the second driving mechanisms may be connected to the first hinge support seats by means of the first driving mechanisms; and the Y-shaped hinge rod may include a first hinge rod and a protruding rod formed by protruding outwards from a middle of the first hinge rod, one end of the first hinge rod being hinged to the first hinge support seat, and the other end thereof being hinged to the force bearing box by means of the hinge rod; and the first driving mechanism may drive the first hinge support seat to move up and down to drive the Y-shaped hinge rod to rotate to penetrate out of the elongated hole, so as to form the abutting portion, having the avoiding position located on the inner side of the pressed portion and the pressing positions located on the upper side and the lower side of the pressed portion separately, at an end of the protruding rod.

Further, the arrangement probe may further include a jacking mechanism fixed in the housing and having an output shaft extending in a radial direction of the housing, where the output shaft may be opposite the pin, and the jacking mechanism may drive the output shaft to move in the radial direction of the housing, so as to push the pin to move towards the sliding mass.

Further, the force bearing box may be hollow, and a through hole may penetrate one side, facing the hinge rod, of the force bearing box; the connection rod assembly may further include a reset spring and a movable rod, one end of the movable rod being fixedly connected to the first hinge support seat, the other end thereof penetrating the through hole to be located in the force bearing box, the reset spring sleeving the movable rod, and an upper end and a lower end of the reset spring abutting against the first hinge support seat and the force bearing box respectively; and the first driving mechanism may be mounted in the force bearing box and drive the movable rod to move up and down.

Further, the first driving mechanism may include a driving electric motor and a metallic line, one end of the metallic line being wound around a rotation shaft of the driving electric motor, and the other end thereof being connected to one end, located in the force bearing box, of the movable rod.

Further, a middle of the vertical groove may protrude towards the sliding mass to form a horizontal groove, the horizontal groove may extend in the radial direction of the casing pipe, and the pin may be located in the horizontal groove.

Further, the casing pipes may include a plurality of first casing pipes and a plurality of second casing pipes, the first casing pipes and the second casing pipes being connected alternatively in sequence, and each of the first casing pipes being provided with the mounting hole.

Further, the arrangement apparatus for multiple integrated sensors in a deep position of a sliding mass may further include a monitoring apparatus, where the monitoring apparatus may include a data acquisition unit in wireless communication with the sensor penetration scissors for lowering same into the casing pipe to receive the monitoring data.

The embodiments of the present disclosure further provides an arrangement method, using the above arrangement apparatus for multiple integrated sensors in a deep position of a sliding mass and including the following steps:

S1, lowering an arrangement probe to a position, corresponding to sensor penetration scissors, in a casing pipe by means of a traction mechanism, then driving, by a first driving mechanism, an abutting portion to be switched between an avoiding position and a pressing position, driving, by a second driving mechanism, the first driving mechanisms to move close to each other in the vertical direction to drive the two pressed portions to rotate close to each other, so as to move the sensor penetration scissors from an initial position to a monitoring position, and then making the sensor penetration scissors cut into a sliding mass outside a borehole; and

S2, performing pressing and shearing action, and then operating S1 reversely after pressing and shearing action is completed, to restore the arrangement probe to an original position.

The technical solution provided by the embodiments of the present disclosure has the beneficial effects that the shear-shaped sensor penetration scissors are mounted on the casing pipe, and the shearing portion cuts into a soil body with stress balanced, so the requirement on the casing pipe is low. Compared with the prior art, the application scene is expanded, the present disclosure is more adaptive to a working condition with higher compactness of the sliding mass, and the related sensors may be better arranged. The arrangement apparatus is designed to apply static force locally, so the arrangement apparatus is not prone to overturn with static force balanced and avoids winding with a low requirement for a pull rope. Disturbance of a monitoring environment is reduced in a static cut-in mode. Moreover, an arrangement range outside the hole is enlarged, which may be better close to an original underground environment, and measures more accurate underground multi-field information of the landslide. By means of arrangement of sensors outside a side wall of the borehole, and wireless transmission and wireless energization of the arrangement probe outside the hole and the monitoring apparatus, multi-parameter information monitoring of rock and soil bodies outside the borehole of the deep position of a sliding mass may be achieved, and a monitoring result is closer to the real underground environment.

Figure 1:
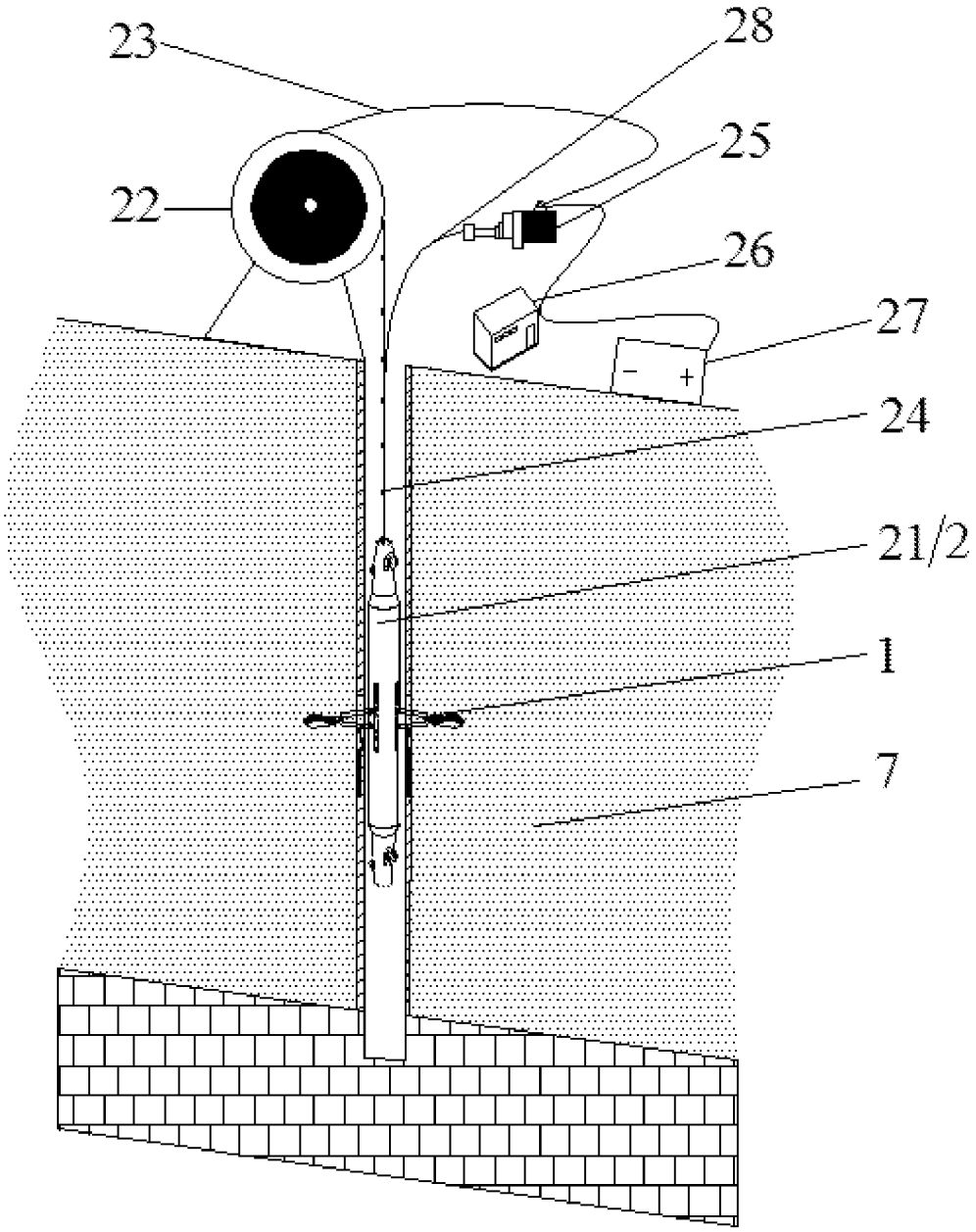
FIG. 1 is a schematic structural diagram of an embodiment of an arrangement apparatus for multiple integrated sensors in a deep position of a sliding mass provided by the present disclosure.
Figure 2:
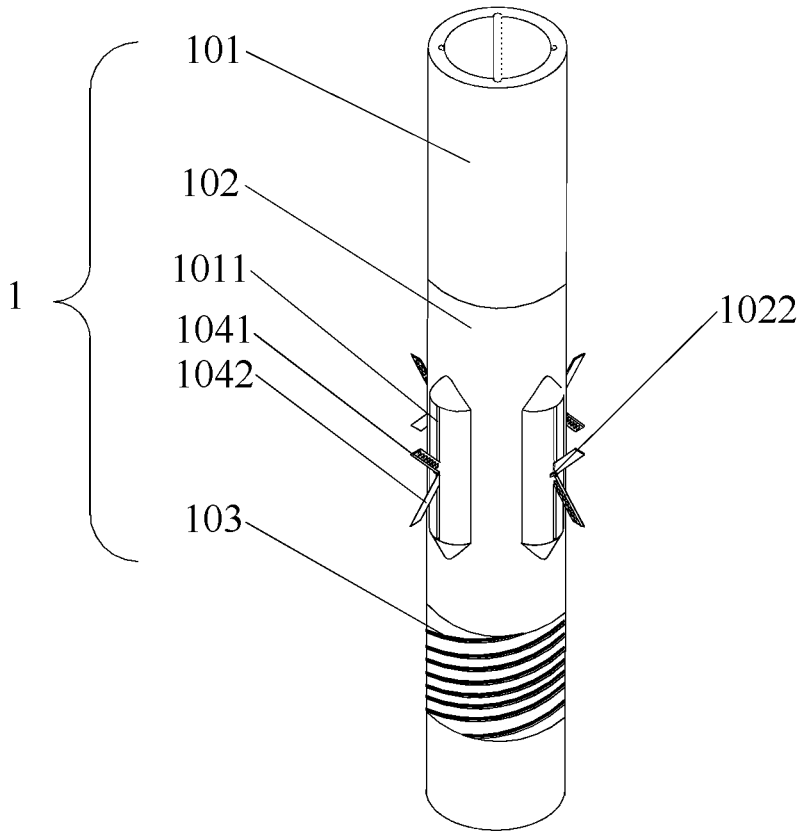
FIG. 2 is a schematic structural diagram of a penetration-type monitor (with sensor penetration scissors located at an initial position) in FIG. 1.
Figure 3:
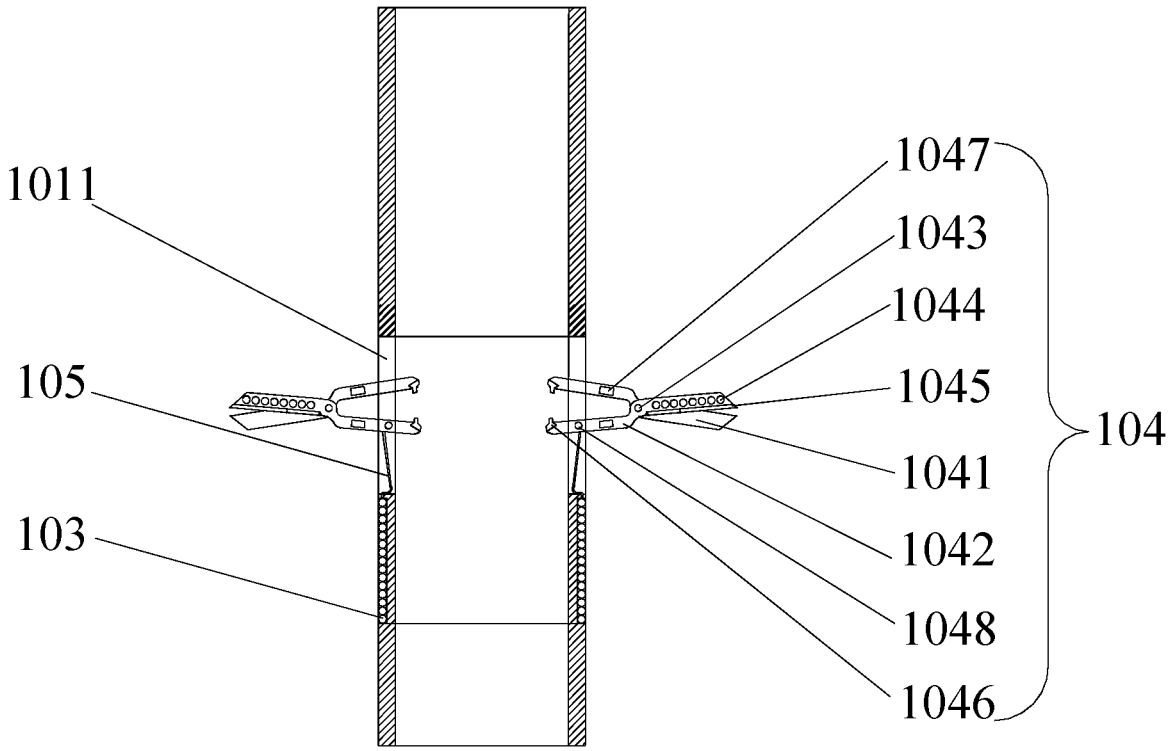
FIG. 3 is a schematic diagram of a cutaway structure of the penetration-type monitor (with the sensor penetration scissors located at a monitoring position) in FIG. 2.
Figure 4:
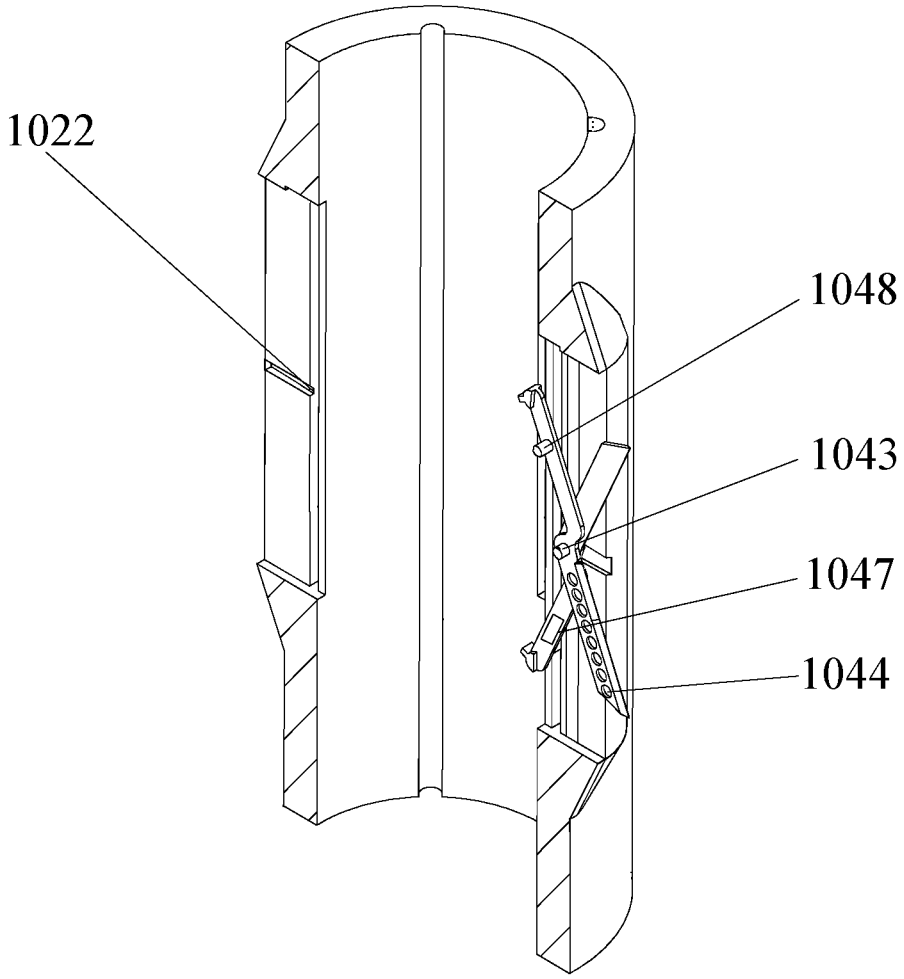
FIG. 4 is a schematic diagram of a partial structure of the penetration-type monitor (with the sensor penetration scissors located at the initial position) in FIG. 2.
Figure 5:
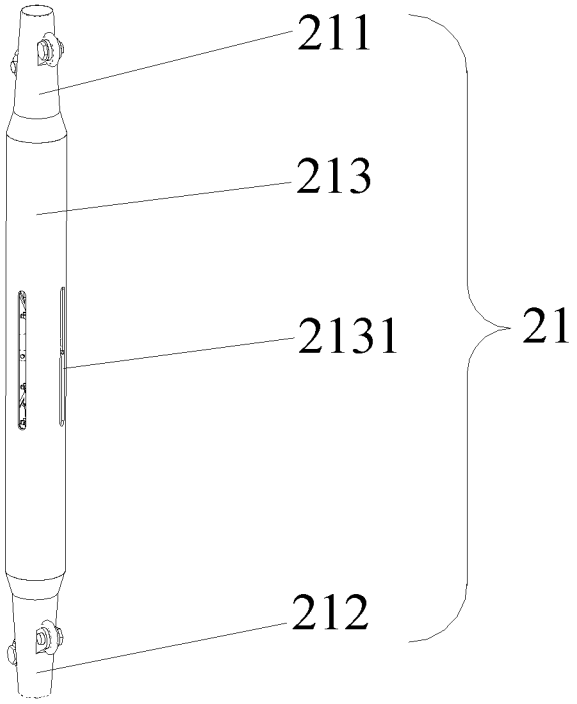
FIG. 5 is a schematic structural diagram of an arrangement probe in FIG. 1.
Figure 6:
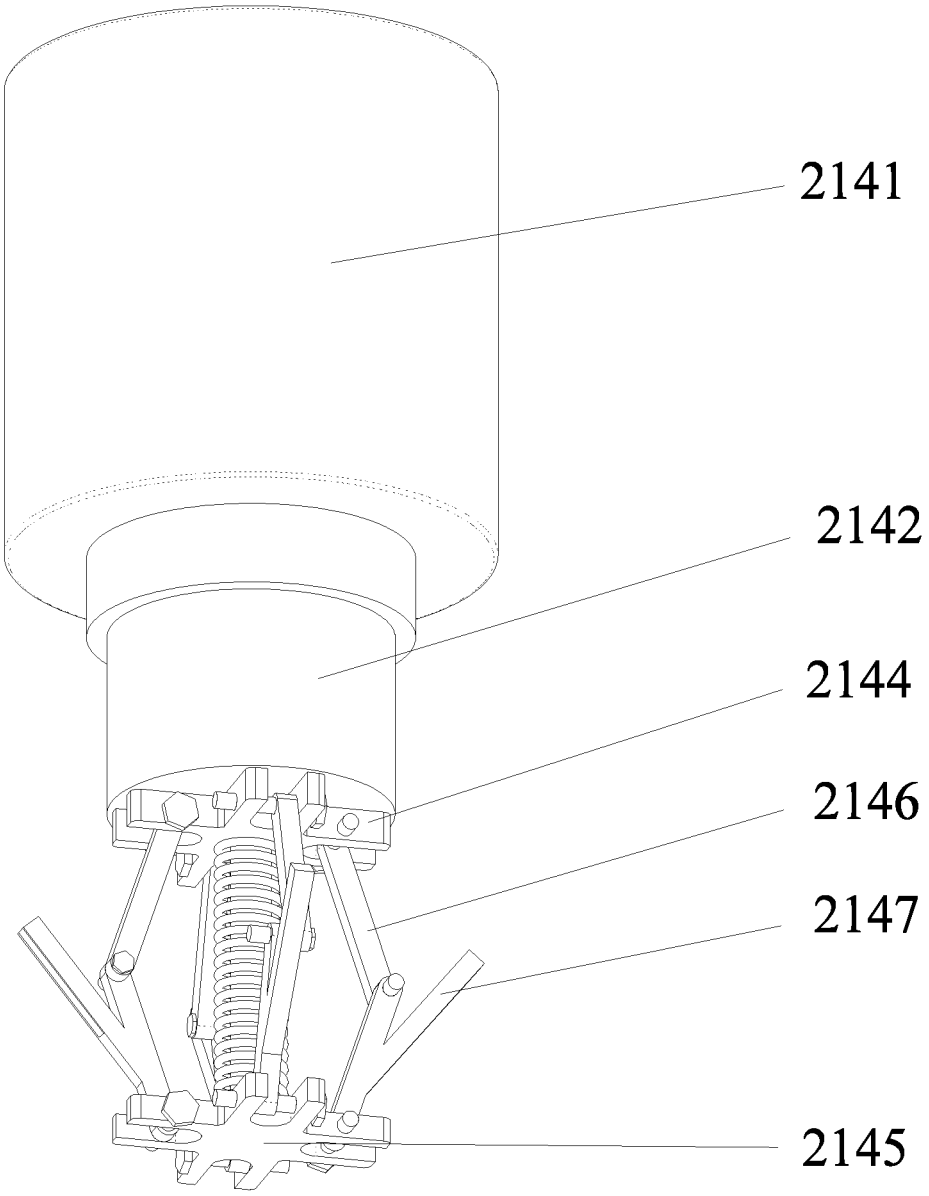
FIG. 6 is a schematic structural diagram of an upper hydraulic jacking device in FIG. 1.

In the figures: penetration-type monitor 1, first casing pipe 101, mounting hole 1011, second casing pipe 102, T-shaped slide groove 1022, extra-pipe coupling coil 103, sensor penetration scissors 104, first blade 1041, second blade 1042, pin 1043, monitoring hole 1044, shearing portion 1045, pressed portion 1046, sensor circuit board 1047, slider 1048, waterproof wire 105, monitor arrangement system 2, arrangement probe 21, upper slide wheel device 211, lower slide wheel device 212, housing 213, elongated hole 2131, upper hydraulic jacking device 214, second driving mechanism 2141, force bearing box 2142, waterproof electric motor 2143, second hinge support seat 2144, first hinge support seat 2145, hinge rod 2146, Y-shaped hinge rod 2147, first hinge rod 2147*a*, protruding rod 2147*b*, reset spring 2148, movable rod 2149, jacking mechanism 215, output shaft 215*a*, lower hydraulic jacking device 216, winch 22, control cable 23, marking ring 24, hydraulic oil pump 25, control system 26, power supply 27, hydraulic oil pipe 28, data acquisition unit 3, measurement circuit board 301, measurement coupling coil 302, solar power supply assembly 4, controller 5, fixed cable 6, sliding mass 7.

DETAILED DESCRIPTION OF THE EMBODIMENTS

In order to make the objectives, technical solutions and advantages of the present disclosure clearer, the implementations of the present disclosure are described in more detail below with reference to the accompanying drawings.

With reference to FIGS. 1-9, the embodiments of the present disclosure provides an arrangement apparatus for multiple integrated sensors in a deep position of a sliding mass, including a penetration-type monitor 1 and a monitor arrangement system 2.

The penetration-type monitor 1 includes a casing pipe and sensor penetration scissors 104, where the casing pipe extends in a vertical direction and is used for being lowered into a borehole. A mounting hole 1011 extending in the vertical direction penetrates through a side wall of the casing pipe, and vertical grooves extending in the vertical direction are provided in opposite side walls of the mounting hole 1011. The casing pipe is provided with the plurality of mounting holes 1011 at an interval one above another, each of the mounting holes 1011 is provided with sensor penetration scissors 104, thereby increasing the number of sensors. Specifically, the casing pipes include a plurality of first casing pipes 101 and a plurality of second casing pipes 102, the first casing pipes 101 and the second casing pipes 102 being connected alternatively in sequence, the first casing pipes 101 being made of stainless steel, the second casing pipes 102 being common casing pipes, and the number of the first casing pipes 101 and the number of the second casing pipes 102 being specifically determined according to a length of the borehole. Each of the first casing pipes 101 is provided with the mounting hole 1011, the first casing pipes 101 are provided with the plurality of mounting holes 1011 in a circumferential direction at intervals, and in this embodiment, the first casing pipe 101 is provided with four mounting holes 1011 evenly in the pipe circumference.

The sensor penetration scissors 104 are used for obtaining monitoring data of a sliding mass 7, is arranged in a shear shape and includes a first blade 1041 and a second blade 1042 which are connected by means of a pin 1043, the first blade 1041 and the second blade 1042 rotating close to each other or away from each other in the vertical direction so as to define an initial position and a monitoring position of the sensor penetration scissors 104, outer ends of the first blade 1041 and the second blade 1042 being shearing portions 1045, inner ends thereof being pressed portions 1046, the shearing portions 1045 being sharpened so as to shear the sliding mass 7, ends of the pressed portions 1046 being located in the casing pipe, sliders 1048 being arranged at positions, opposite the vertical grooves, of the pressed portions 1046, and the sliders 1048 sliding up and down in the vertical grooves. In this embodiment, the slider 1048 is cylindrical and limited in the vertical groove, and then the pressed portion 1046 may slide vertically, thereby achieving shearing action of the sensor penetration scissors 104.

The sensor penetration scissors 104 further include a sensor and a sensor circuit board 1047, the sensor is mounted on the shearing portion 1045, a plurality of monitoring holes 1044 are provided in the shearing portion 1045, and various sensors, for example, a soil pressure sensor, a moisture content monitoring sensor, a seepage sensor, a pore water pressure sensor, etc., may be mounted in the monitoring holes 1044. The sensor circuit board 1047 is mounted on the sensor penetration scissors 104 (specifically mounted on the pressed portion 1046) for processing monitoring information from the sensor, and waterproof sealing processing is conducted on a surface of the sensor circuit board 1047.

Further, a middle of the vertical groove protrudes towards the sliding mass 7 to form a horizontal groove, the horizontal groove extends in a radial direction of the casing pipe, the pin 1043 is located in the horizontal groove, then the sensor penetration scissors 104 may horizontally slide, the vertical groove and the horizontal groove form a T-shaped slide groove 1022, in this embodiment, the vertical groove and the horizontal groove have square cross sections, and a size of the horizontal groove and a size of the pin 1043 on the cross section are larger than a size of the vertical groove on the cross section, and accordingly, the pin 1043 may not enter the vertical groove, and the sensor penetration scissors 104 are prevented from sliding into an inner side of the casing pipe.

When the sensor penetration scissors 104 are located at the initial position, the ends of the pressed portions 1046 of the first blade 1041 and the second blade 1042 may be arranged at an interval one above the other, when the sensor penetration scissors 104 are located at the monitoring position, the pressed portions 1046 move close to each other, and the shearing portions 1045 penetrate out of the mounting hole 1011 to shear the sliding mass 7.

The monitor arrangement system 2 drives the sensor penetration scissors 104 to move from the initial position to the monitoring position, the monitor arrangement system 2 may be two hydraulic oil cylinders fixed to the casing pipe, and an end of a piston rod of each hydraulic oil cylinder abuts against the pressed portion 1046 to drive the pressed portions 1046 to move close to each other. In this embodiment, the monitor arrangement system 2 includes a traction mechanism and an arrangement probe 21 which may be placed into the casing pipe, the arrangement probe 21 having a vertical movement stroke, an inner side wall of the casing pipe is provided with a guide groove for the arrangement probe 21 to slide up and down (a guide groove of the first casing pipe 101 is in communication with a guide groove of the second casing pipe 102), and the traction mechanism being connected to the arrangement probe 21 so as to pull the arrangement probe 21 to move in the vertical direction.

Specifically, the traction mechanism includes a winch 22, a control cable 23, a marking ring 24, a hydraulic oil pump 25, a control system 26, a power supply 27 and a hydraulic oil pipe 28. The arrangement probe 21 is connected to the winch 22 by means of the control cable 23, under the control of the control system 26, the control cable 23 is pulled by the winch 22 to lower the arrangement probe 21 into the borehole, the power supply 27 supplies power to the entire monitor arrangement system 2, the hydraulic oil pump 25 is connected to the arrangement probe 21 by means of the hydraulic oil pipe 28, the control cable 23 is provided with the marking rings 24 at fixed intervals for controlling an upward traction distance, such that the arrangement probe 21 of the monitor corresponds to the sensor penetration scissors 104 when traction is stopped each time.

The arrangement probe 21 is used for static pressure opening of the sensor penetration scissors 104 until the shearing portions 1045 of the first blade 1041 and the second blade 1042 cut into the sliding mass 7 outside the hole. The arrangement probe 21 includes a housing 213, two abutting portions, two first driving mechanisms and a second driving mechanism 2141, where the housing 213 is hollow, an upper slide wheel device 211 and a lower slide wheel device 212 are arranged at an upper end and a lower end of the housing 213 respectively, the upper slide wheel device 211 and the lower slide wheel device 212 may slide up and down in the guide groove in the casing pipe, which guides the arrangement probe 21 to slide in the vertical direction. Each abutting portion may be movably mounted on the corresponding first driving mechanism, and the two abutting portions may be provided with avoiding positions located on an inner side of the pressed portion 1046 and pressing positions located on an upper side and a lower side of the pressed portion 1046 separately; and the first driving mechanisms may be movably mounted on the housing 213 in the vertical direction and drive the abutting portions to be switched between the avoiding positions and the pressing positions separately, the second driving mechanism 2141 may be fixed to the housing 213 and drives the first driving mechanisms to move close to each other in the vertical direction to drive the two pressed portions 1046 to rotate close to each other so as to move the sensor penetration scissors 104 from the initial position to the monitoring position. The two second driving mechanisms 2141 are arranged in the housing 213 at an interval one above the other, and in this embodiment, the second driving mechanisms 2141 are jacks and are connected to the hydraulic oil pump 25 by means of the hydraulic oil pipe 28.

The arrangement probe 21 further includes two connection rod assemblies, elongated holes 2131 extending in the vertical direction penetrate a side wall of the housing 213, the four elongated holes 2131 are evenly provided in the housing 213 in the circumferential direction, and the connection rod assemblies correspond to the second driving mechanisms 2141 in a one-to-one manner, are located between the two second driving mechanisms 2141, and include force bearing boxes 2142, first hinge support seats 2145, second hinge support seats 2144, hinge rods 2146 and Y-shaped hinge rods 2147; and the force bearing box 2142 is fixed to the second driving mechanism 2141 and may move up and down in cooperation with extension of the jack. The two first hinge support seats 2145 are located between the two force bearing boxes 2142, and the second driving mechanism 2141 is connected to the first hinge support seats 2145 by means of the first driving mechanism; and the Y-shaped hinge rod 2146 includes a first hinge rod 2147*a* and a protruding rod 2147*b* formed by protruding outwards from a middle of the first hinge rod 2147*a*, and one end, away from the first hinge rod 2147*a*, of the protruding rod 2147*b* is of a V shape on the cross section to prevent sideslip when the pressed portion 1046 is pressed. One end of the first hinge rod 2147*a* is hinged to the first hinge support seat 2145, the other end thereof is hinged to the force bearing box 2142 by means of the hinge rod 2146, in this embodiment, the second hinge support seat 2144 is fixed to the force bearing box 2142, the hinge rod 2146 is hinged to the second hinge support seat 2144, and the hinge rod 2146 and the Y-shaped hinge rod 2147 are hinged to the first hinge support seat 2145 and the second hinge support seat 2144 to form a flexible truss. In this embodiment, four flexible trusses are provided and one-to-one opposite the four elongated holes 2131 and the four mounting holes 1011. The first driving mechanism drives the first hinge support seat 2145 to move up and down to drive the Y-shaped hinge rod 2146 to rotate to penetrate out of the elongated hole 2131, so as to form the abutting portion, having the avoiding position located on the inner side of the pressed portion 1046 and the pressing positions located on the upper side and the lower side of the pressed portion 1046 separately, at an end of the protruding rod 2147*b*. The flexible truss may be changed into a multi-section truss according to a range requirement so as to enlarge the range.

Figure 7:
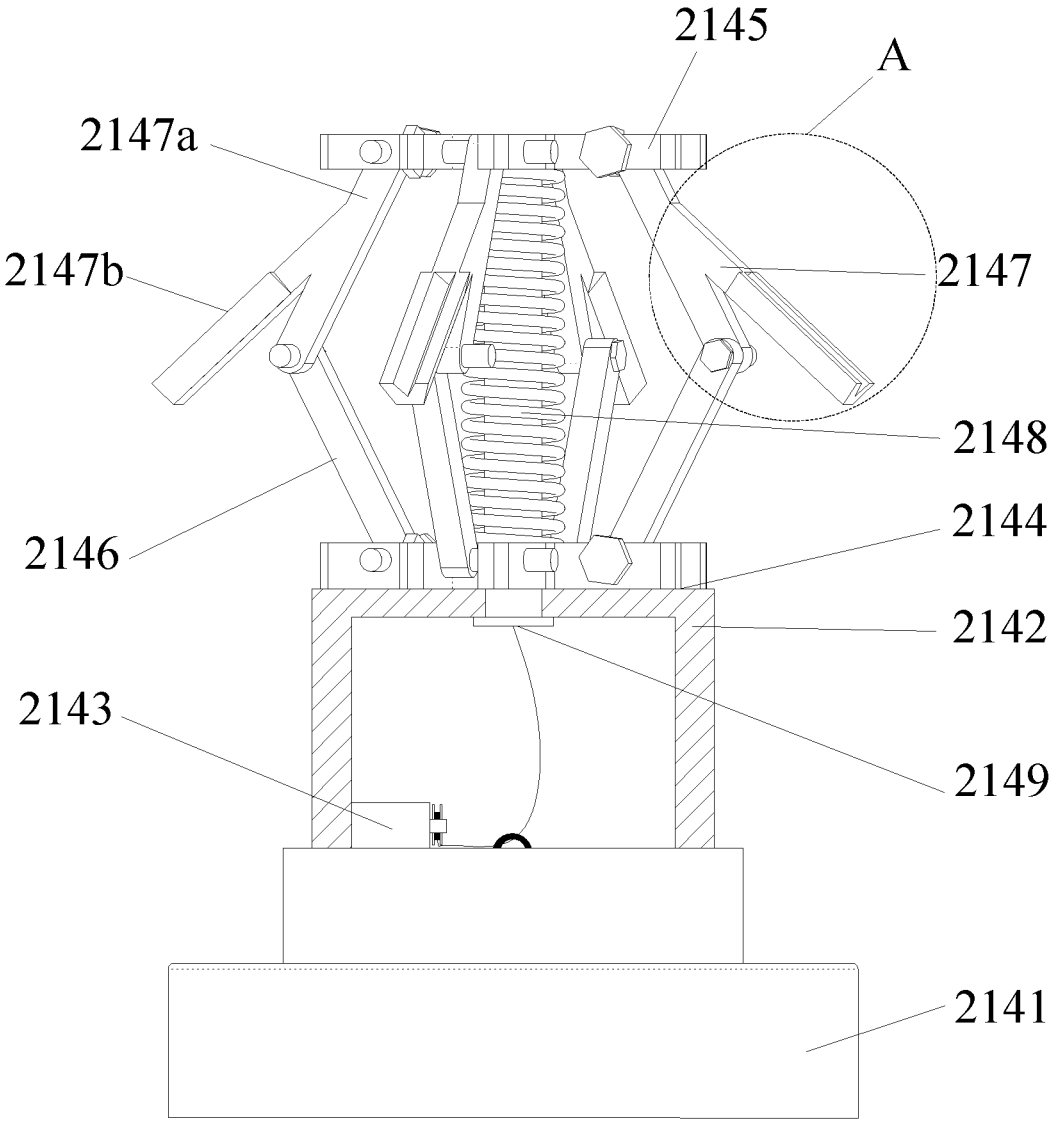
FIG. 7 is a schematic partial cutaway view of a lower hydraulic jacking device in FIG. 1.
Figure 8:
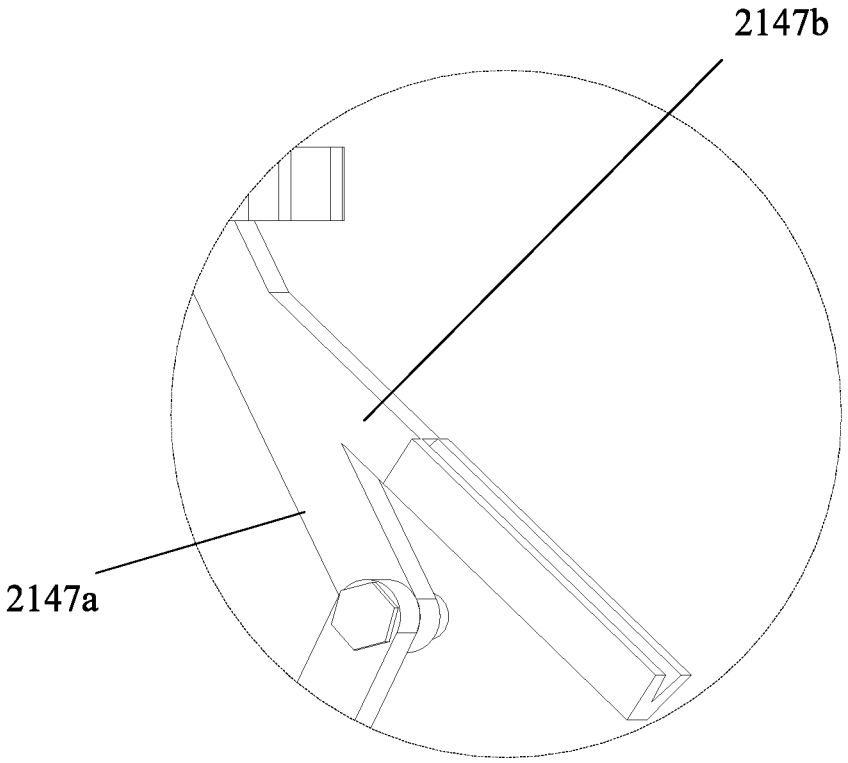
FIG. 8 is an enlarged schematic view of A in FIG. 7.
Figure 9:
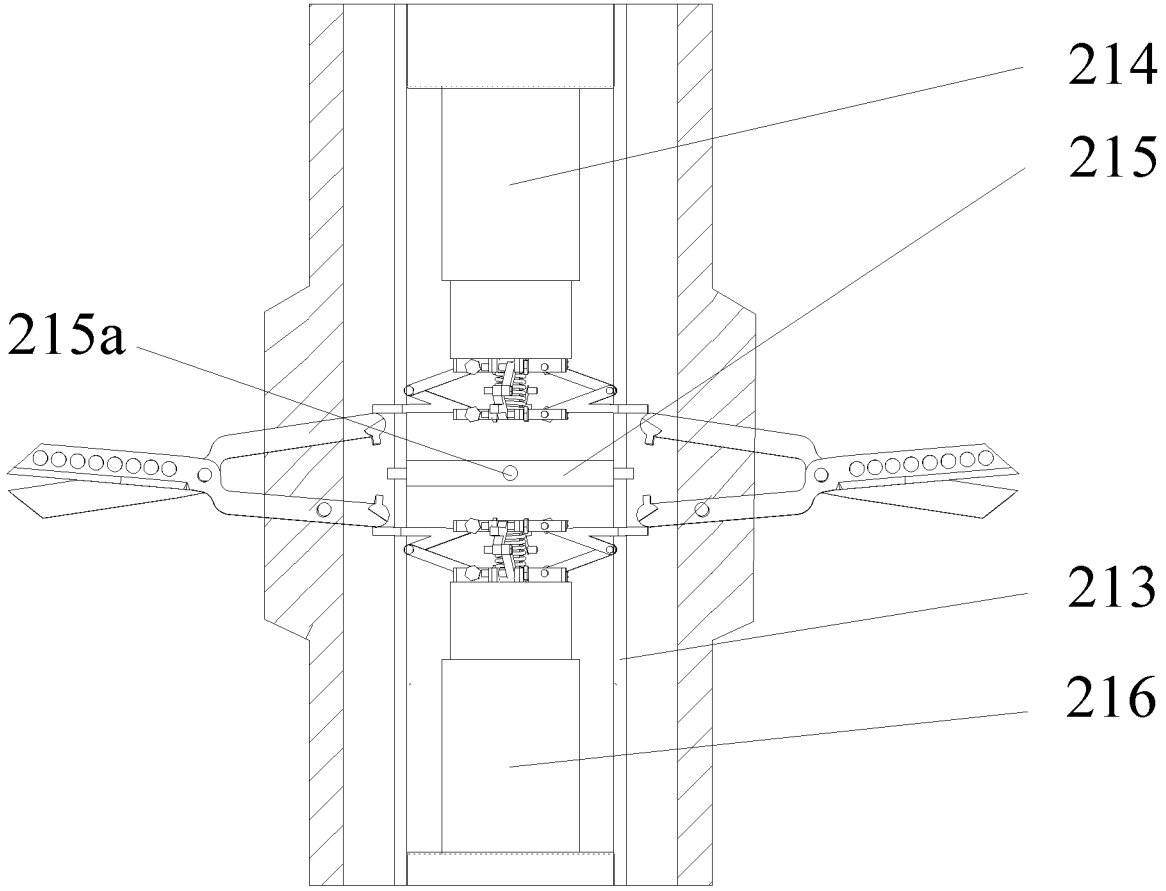
FIG. 9 is a schematic diagram of a cutaway structure of the arrangement probe in FIG. 1.

Further, with reference to FIG. 7, the force bearing box 2142 is hollow, a through hole penetrates one side, facing the hinge rod 2146, of the force bearing box 2142, and a receding hole is provided in a position, opposite the through hole, of the second hinge support seat 2144; the connection rod assembly further includes a reset spring 2148 and a movable rod 2149, one end of the movable rod 2149 being fixedly connected to the first hinge support seat 2145, the other end thereof penetrating the through hole and the receding hole to be located in the force bearing box 2142, the reset spring 2148 sleeving the movable rod 2149, and an upper end and a lower end of the reset spring 2148 abutting against the first hinge support seat 2145 and the force bearing box 2142 respectively; and the first driving mechanism is mounted in the force bearing box 2142 and drives the movable rod 2149 to move up and down, the movable rod 2149 moves in the through hole and the receding hole to guide the first hinge support seat 2145 to move up and down, and it is guaranteed that the first hinge support seat 2145 returns to the initial position by means of an elastic reset function of the reset spring 2148. A size of one end, located in the force bearing box 2142, of the movable rod 2149 is larger than a size of the through hole, so as to limit the end of the movable rod 2149 in the force bearing box 2142 to prevent the movable rod 2149 from falling off.

In this embodiment, the first driving mechanism includes a driving electric motor and a metallic line, one end of the metallic line being wound around a rotation shaft of the driving electric motor, the other end thereof being connected to one end, located in the force bearing box 2142, of the movable rod 2149, the driving electric motor is subjected to waterproof treatment, and the metallic line is pulled by a waterproof electric motor 2143 to be wound around the rotation shaft, so as to drive the movable rod 2149 to move towards the jack.

The connection rod assembly, the first driving mechanism and the second driving mechanism 2141 on an upper portion of the housing 213 form an upper hydraulic jacking device 214, the connection rod assembly, the first driving mechanism and the second driving mechanism 2141 on a lower portion of the housing 213 form a lower hydraulic jacking device 216, and the upper hydraulic jacking device 214 and the lower hydraulic jacking device 216 have identical structures and are symmetrically arranged.

Further, the arrangement probe 21 may further include a jacking mechanism 215 fixed in the housing 213 and having an output shaft 215*a* extending in a radial direction of the housing 213, where the output shaft 215*a* may be opposite the pin 1043, and the jacking mechanism 215 may drive the output shaft 215*a* to move in the radial direction of the housing 213, so as to push the pin 1043 to move towards the sliding mass 7. Four output shafts 215*a* of the jacking mechanism 215 extend in a radial direction of the casing pipe and are opposite the four mounting holes 1011 in a one-to-one manner, the jacking mechanism 215 is a hydraulic jack, and the output shafts 215*a* are piston shafts of the hydraulic jack, which facilitates the shearing action of the sensor penetration scissors 104.

Figure 11:
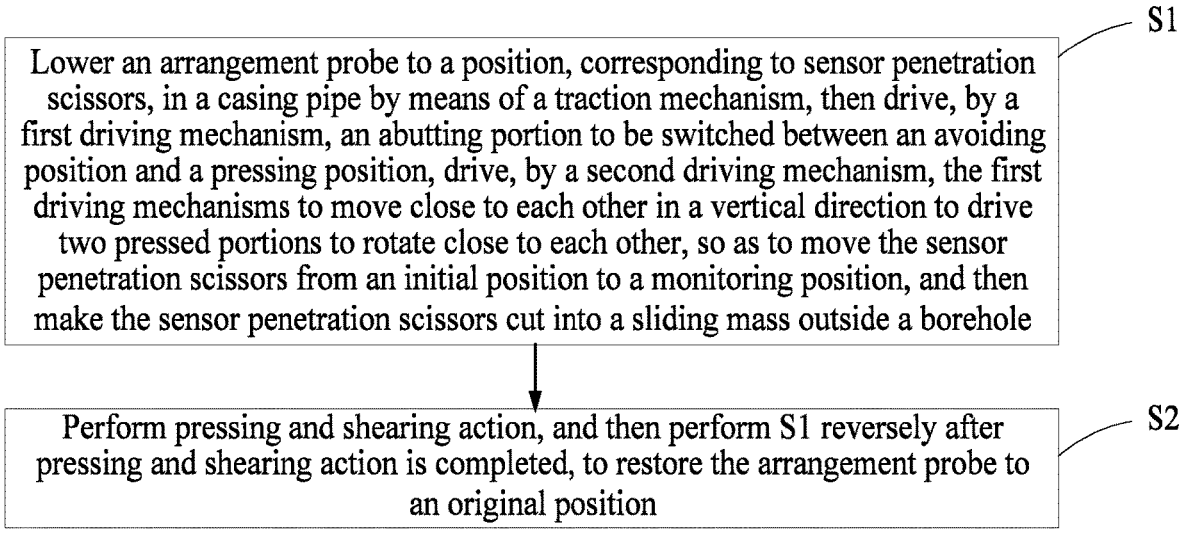
FIG. 11 is a flowchart of an embodiment of an arrangement method provided by the present disclosure.

The present disclosure further provides an arrangement method, with reference to FIG. 11, using the above arrangement apparatus for multiple integrated sensors in a deep position of a sliding mass and including the following steps:

S1, an arrangement probe 21 is lowered to a position, corresponding to sensor penetration scissors 104, in a casing pipe by means of a traction mechanism, then a first driving mechanism drives an abutting portion to be switched between an avoiding position and a pressing position, a second driving mechanism 2141 drives the first driving mechanisms to move close to each other in the vertical direction to drive the two pressed portions 1046 to rotate close to each other so as to move the sensor penetration scissors 104 from an initial position to a monitoring position, and then the sensor penetration scissors 104 cut into a sliding mass 7 outside a borehole; and S2, pressing and shearing action is performed, and then S1 is performed reversely after pressing and shearing action is completed, to restore the arrangement probe to an original position.

Specifically, in this embodiment, the arrangement method includes: step 1, the arrangement probe 21 is lowered to the corresponding position of a first casing pipe 101 in the sliding mass 7 according to a marking ring 24, then waterproof electric motors 2143 in an upper hydraulic jacking device 214 and a lower hydraulic jacking device 216 pull a metallic line, then two movable rods 2149 drive a first hinge support seat 2145 to move away, when one end, located in the force bearing box 2142, of the movable rod 2149 abuts against one side, close to a jack, of the force bearing box 2142, four flexible trusses are compressed and expanded, the protruding rods 2147*b* of the Y-shaped hinge rod 2147 penetrate out of the elongated hole 2131 of the housing 213, and the two protruding rods 2147*b* are located on an upper side and a lower side of the pressed portion 1046.

Step 2, a piston shaft of a jacking mechanism 215 penetrates out of the elongated hole 2131 to jack a pin 1043 to move out of a borehole, jacks in an upper hydraulic jacking device 214 and a lower hydraulic jacking device 216 jack downwards and upwards simultaneously to drive the flexible trusses to move close to each other until the protruding rod 2147*b* of a Y-shaped hinge rod 2147 abuts against the pressed portions 1046 of a first blade 1041 and a second blade 1042, the jacks continue for jacking, and under the action of the jacks, the sensor penetration scissors 104 cut into the sliding mass 7 outside the borehole.

Step 3, the pressing and shearing action is performed, then step 2 is performed reversely after the pressing and shearing action is completed, to restore the arrangement probe 21 to the original position and then is lifted upwards to a corresponding position of a last first casing pipe 101 according to the marking ring 24.

Step 4, steps 1-3 are performed circularly.

Figure 10:
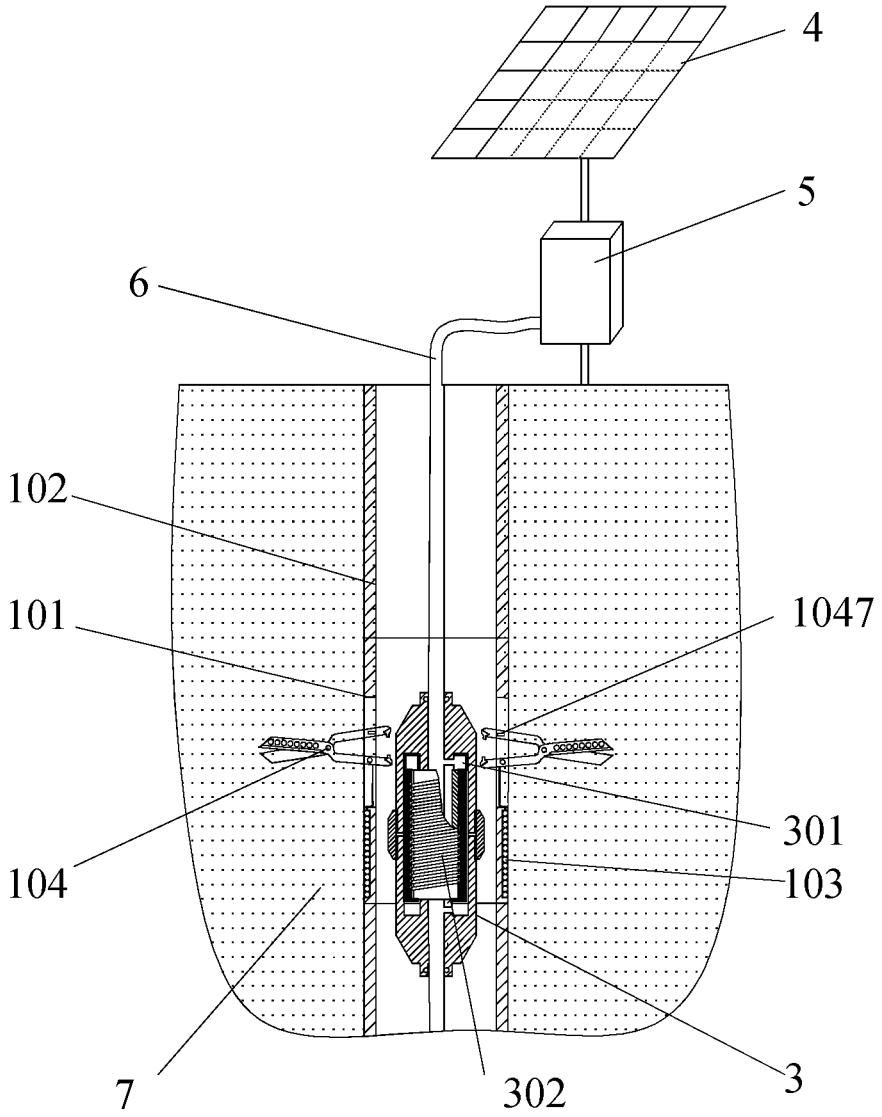
FIG. 10 is a schematic structural diagram of a monitoring apparatus of one embodiment of the arrangement apparatus for multiple integrated sensors in a deep position of a sliding mass provided by the present disclosure.

Further, with reference to FIG. 10, the arrangement apparatus for multiple integrated sensors in a deep position of a sliding mass further includes a monitoring apparatus, where the monitoring apparatus includes a data acquisition unit 3, a power supply device arranged outside the borehole, and a controller 5.

The power supply device is electrically connected to the sensor and the sensor circuit board 1047, in this embodiment, the power supply device is a solar power supply assembly 4, and the solar power supply assembly 4 is electrically connected to the data acquisition unit 3 and the controller 5 by means of fixed cables 6 to continuously supply power to same.

The data acquisition unit 3 is in wireless communication with the sensor penetration scissors 104 for lowering same into the casing pipe to receive the monitoring data. Specifically, an extra-pipe coupling coil 103 is annularly arranged on a periphery of the casing pipe (the first casing pipe 101), and the extra-pipe coupling coil 103 is electrically connected to the sensor circuit board 1047 by means of a waterproof wire 105; and the data acquisition unit 3 includes a measurement circuit board 301 and a measurement coupling coil 302, the measurement coupling coil 302 being wirelessly coupled with the extra-pipe coupling coil 103 and is electrically connected to the measurement circuit board 301. The measurement coupling coil 302 may be wirelessly coupled with the extra-pipe coupling coil 103 to achieve power supply to the sensor penetration scissors 104 and near-field communication, and the measurement coupling coil 302 and the extra-pipe coupling coil 103 may be sealed and protected by sealant.

The measurement circuit board 301 and the measurement coupling coil 302 in the data acquisition unit 3 are electrically connected to the solar power supply assembly 4 by means of the fixed cable 6, and the solar power supply assembly 4 continuously supplies power to the measurement circuit board 301 and the measurement coupling coil 302. The controller 5 is electrically connected to the power supply device and the data acquisition unit 3, and the controller 5 is used for processing information acquired by the data acquisition unit 3 and being in communication connection with the outside, for example, uploading monitoring information to the Internet, etc. The measurement circuit board 301, the measurement coupling coil 302 and the controller 5 are electrically connected by means of the fixed cable 6. The specific structure of the monitoring apparatus may be found in the patent with a publication number of CN110736498B and a name of SYSTEM AND METHOD FOR MONITORING MULTIPLE PARAMETERS OUTSIDE DEEP HOLE OF SLIDING MASS, and is not described in detail herein.

The embodiment of the present disclosure further provides a wireless multi-field information monitoring method outside a hole:

Step 1, after early-stage survey work of a landslide is completed, a hole is drilled in a key position of a sliding mass 7, and arrangement of the penetration-type monitor 1 is completed by means of the monitor arrangement system 2.

Step 2, the data acquisition unit 3 is lowered to a position corresponding to the casing pipe by means of the fixed cable 6.

Step 3, the solar power supply assembly 4 continuously supplies power to the sensor by means of wireless coupling between the extra-pipe coupling coil 103 and the measurement coupling coil 302, the sensor continuously performs monitoring after being electrified, and monitoring information is processed by the sensor circuit board 1047, achieves near-field communication by means of wireless coupling between the measurement coupling coil 302 and the extra-pipe coupling coil 103, and is transmitted to the measurement circuit board 301. The measurement circuit board 301 and sensor circuit board 1047 include a wireless communication module, for example, Blue tooth or Zigbee.

Step 4, the measurement circuit board 301 transmits the monitoring information to the controller 5, and the controller 5 processes the monitoring information and then uploads the same to a network.

Herein, the involved terms including front, rear, upper, lower, etc., are defined in terms of the positions of parts and between the parts in the drawings, just for clarity and convenience of expressing the technical scheme. It should be understood that the use of such parties should not limit the scope of protection of the claimed application.

The embodiment in the present disclosure and the features in the embodiments may be combined with each other in a non-conflicting situation.

The above-mentioned are merely preferred embodiments of the present disclosure, and are not intended to limit the present disclosure. Any modifications, equivalent replacements and improvements made within the spirit and principle of the present disclosure should be included in the protection scope of the present disclosure.

What is claimed is:

1. An arrangement apparatus for multiple integrated sensors in a deep position of a sliding mass, comprising:

a penetration-type monitor comprising a casing pipe and sensor penetration scissors, wherein the casing pipe extends in a vertical direction and is configured to be lowered into a borehole, a mounting hole extending in the vertical direction penetrates through a side wall of the casing pipe, and vertical grooves extending in the vertical direction are provided in opposite side walls of the mounting hole;

the sensor penetration scissors are used for obtaining monitoring data of the sliding mass, is arranged in a shear shape and comprises a first blade and a second blade which are connected by means of a pin, the first blade and the second blade rotating close to each other or away from each other in the vertical direction so as to define an initial position and a monitoring position of the sensor penetration scissors, outer ends of the first blade and the second blade being shearing portions, inner ends thereof being pressed portions, and ends of the pressed portions being located in the casing pipe; sliders are arranged at positions, opposite the vertical grooves, of the pressed portions, and the sliders slide up and down in the vertical grooves;

when the sensor penetration scissors are located at the initial position, the ends of the pressed portions of the first blade and the second blade are arranged at an interval one above the other; and when the sensor penetration scissors are located at the monitoring position, the pressed portions move close to each other, and the shearing portions penetrate out of the mounting hole to shear the sliding mass; and a monitor arrangement system driving the sensor penetration scissors to move from the initial position to the monitoring position.

2. The arrangement apparatus according to claim 1, wherein the monitor arrangement system comprises a traction mechanism and an arrangement probe which may be placed into the casing pipe, the arrangement probe having a vertical movement stroke, and the traction mechanism being connected to the arrangement probe so as to pull the arrangement probe to move in the vertical direction;

the arrangement probe comprises a housing, two abutting portions, two first driving mechanisms and a second driving mechanism; each abutting portion is movably mounted on the corresponding first driving mechanism, and the two abutting portions are provided with avoiding positions located on an inner side of the pressed portion and pressing positions located on an upper side and a lower side of the pressed portion separately; the first driving mechanisms are movably mounted on the housing in the vertical direction and drive the abutting portions to be switched between the avoiding positions and the pressing positions separately; and the second driving mechanism is fixed to the housing and drives the first driving mechanisms to move close to each other in the vertical direction to drive the two pressed portions to rotate close to each other, so as to move the sensor penetration scissors from the initial position to the monitoring position.

3. The arrangement apparatus according to claim 2, wherein the arrangement probe further comprises two connection rod assemblies; the housing is hollow, an elongated hole extending in the vertical direction penetrates through a side wall of the housing, and the two second driving mechanisms are arranged in the housing at an interval one above the other; the connection rod assemblies correspond to the second driving mechanisms in a one-to-one manner, are located between the two second driving mechanisms and comprise force bearing boxes, first hinge support seats, hinge rods and Y-shaped hinge rods;

the force bearing boxes are fixed to the second driving mechanisms, the two first hinge support seats are located between the two force bearing boxes, and the second driving mechanisms are connected to the first hinge support seats by means of the first driving mechanisms; the Y-shaped hinge rod comprises a first hinge rod and a protruding rod formed by protruding outwards from a middle of the first hinge rod, one end of the first hinge rod being hinged to the first hinge support seat, and the other end thereof being hinged to the force bearing box by means of the hinge rod; and the first driving mechanism drives the first hinge support seat to move up and down to drive the Y-shaped hinge rod to rotate to penetrate out of the elongated hole, so as to form the abutting portion, having the avoiding position located on the inner side of the pressed portion and the pressing positions located on the upper side and the lower side of the pressed portion separately, at an end of the protruding rod.

4. The arrangement apparatus according to claim 3, further comprising a jacking mechanism fixed in the housing and having an output shaft extending in a radial direction of the housing, wherein the output shaft is opposite the pin, and the jacking mechanism drives the output shaft to move in the radial direction of the housing, so as to push the pin to move towards the sliding mass.

5. The arrangement apparatus according to claim 3, wherein the force bearing box is hollow, and a through hole penetrates one side, facing the hinge rod, of the force bearing box; the connection rod assembly further comprises a reset spring and a movable rod, one end of the movable rod being fixedly connected to the first hinge support seat, the other end thereof penetrating the through hole to be located in the force bearing box, the reset spring sleeving the movable rod, an upper end and a lower end of the reset spring abutting against the first hinge support seat and the force bearing box respectively; and the first driving mechanism is mounted in the force bearing box and drives the movable rod to move up and down.

6. The arrangement apparatus according to claim 5, wherein the first driving mechanism comprises a driving electric motor and a metallic line, a first end of the metallic line being wound around a rotation shaft of the driving electric motor, and a second end of the metallic line being connected to a first end, located in the force bearing box, of the movable rod.

7. The arrangement apparatus according to claim 1, wherein a middle of the vertical groove protrudes towards the sliding mass to form a horizontal groove, the horizontal groove extends in a radial direction of the casing pipe, and the pin is located in the horizontal groove.

8. The arrangement apparatus according to claim 1, wherein the casing pipe comprise a plurality of first casing pipes and a plurality of second casing pipes, the first casing pipes and the second casing pipes being connected alternatively in sequence, and each of the first casing pipes being provided with the mounting hole.

9. The arrangement apparatus for multiple integrated sensors in a deep position of the sliding mass according to claim 1, further comprising a monitoring apparatus, wherein the monitoring apparatus comprises a data acquisition unit in wireless communication with the sensor penetration scissors for lowering same into the casing pipe to receive the monitoring data.

* * * * *